United States Patent [19]

Egholm

[11] 4,127,298

[45] Nov. 28, 1978

[54] CRANE GRAB

[75] Inventor: Poul V. Egholm, Egå, Denmark

[73] Assignee: Knud W. Petersen, Portland, Oreg.

[21] Appl. No.: 763,903

[22] Filed: Jan. 31, 1977

[51] Int. Cl.[2] ..... B66C 1/10

[52] U.S. Cl. ..... 294/111; 294/70; 37/186

[58] Field of Search ..... 294/111, 110 R, 70, 294/71, 83 R, 88, 106, 108, 109, 112; 37/183 R, 183 A, 184, 186, 187, 188; 214/147 G, 656, 657

[56] References Cited

U.S. PATENT DOCUMENTS

| | | | |
|---|---|---|---|
| 226,557 | 4/1880 | Seward | 294/70 |
| 512,825 | 1/1894 | Hunt | 37/186 |

*Primary Examiner*—James B. Marbert

*Attorney, Agent, or Firm*—Klarquist, Sparkman, Campbell, Leigh, Hall & Whinston

[57] ABSTRACT

A crane grab suspended by a single crane wire includes an operator-activated control means shiftable between a first position, in which open grab halves will be closed for digging in response to the crane wire being hoisted, and a second position, in which the grab halves are allowed to open themselves when placed on the ground and thereafter hoisted again.

2 Claims, 5 Drawing Figures

CRANE GRAB

BACKGROUND OF THE INVENTION

The present invention relates to crane grabs for digging loose material such as earth or sand. More particularly the invention relates to grabs of the kind adapted to be operated by a single crane wire only, i.e. grabs which are operable by means of simple cranes such as ordinary building cranes having a single hoist wire only. It has already been suggested to provide a grab for this purpose with manually operable selector means shiftable between a position, in which the open grab will be closed for digging in response to the crane wire being hoisted, and a position in which the grab is allowed to open itself when it has been placed on the ground and is thereafter lifted again. Of course, it is an advantage that the grab may be used in connection with an ordinary building crane, but it is disadvantageous that in operation the grab will require the assistance of an additional operator for operating the selector means on the ground.

SUMMARY OF THE INVENTION

It is the purpose of this invention to provide a grab of the type referred to which can be operated to perform all its desired functions solely by the crane operator himself. To this end it would be possible to connect the grab structure with the crane operator's position by means of a special control wire enabling the operator himself to shift the said selector means, by pulling the wire or by sending an electric control signal through the wire to an electromagnetically operated selector, but this would involve the use of a special control wire. It is a further purpose of the invention, therefore, to provide a grab structure which may be operated solely by means of the single crane wire for performing the desired functions.

According to the invention there is provided a grab structure which is constructed so as to be able to be closed in response to the crane wire being hoisted up whereafter by further hoisting the grab is lifted as a whole, whereas sensing means are provided which, when the grab is thereafter placed on the ground or elsewhere where the grab load is to be unloaded, detect the slacking of the wire and in response thereto effect switch over of a control mechanism serving to render the grab openable by renewed lifting thereof; the control mechanism is designed so as to be operated again in response to the opened grab being deposited on the ground at the place where digging should be effected, in such a manner that by renewed hoisting up of the crane wire the grab will be closed and thereafter lifted.

BRIEF DESCRIPTION OF THE DRAWINGS

By way of example the invention is described in more detail in the following, reference being made to the accompanying drawing, in which.

DESCRIPTION OF THE PREFERRED EMBODIMENT

Figure 2:
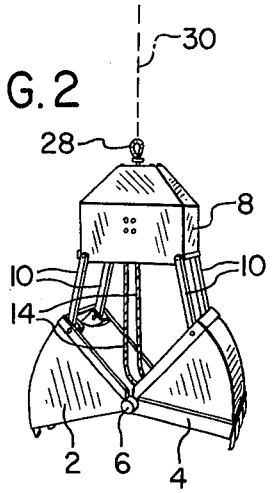
Figure 3:
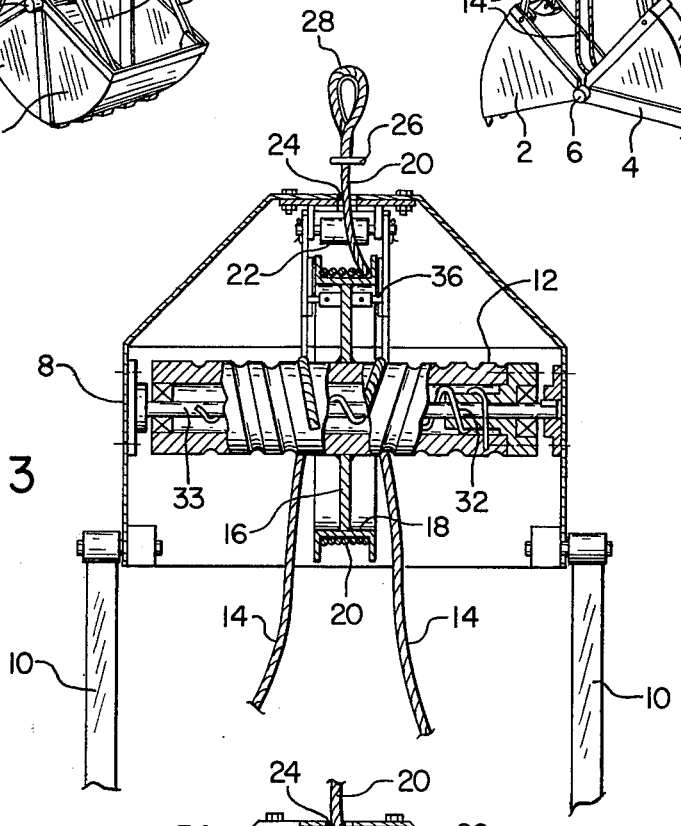
FIG. 3 is a sectional front elevation of the upper part of the grab.

The grab shown in the drawing comprises two lower grab halves 2 and 4 which are journalled on a common grab shaft 6. The outer top edges of the grab halves are connected to an overhead housing 8 by means of pairs of levers 10 which are pivotally secured at both ends. Inside the housing 8, parallel with the grab shaft 6, there is arranged a rotatable drum 12 onto which there is wound or windable one end of a grab chain or cable 14 the other end of which extends down to the grab shaft 6 to which it is secured. As shown in FIGS. 2 and 3 there is preferably used two cables 14 arranged in a symmetrical manner about the middle of the drum 12.

Midway on the drum 12 there is secured a pulley 16 having an exterior annular flange portion 18 onto which there is wound a control chain or cable 20 which, guided by a roller 22, leaves the housing 8 through a top hole 24 therein. The upper end of the control cable 20 is provided with a stop member 26 and an eyelet 28 adapted to be connected to the lifting hook of a crane wire 30. The drum 12 is biased by means of a spring 32 tending to rotate the drum 12 about a drum shaft 33 and thereby wind up the control cable 20 on the drum and correspondingly wind off the grab cable 14. It will be understood that the grab is openable by winding off the cable 14 and closable by winding this cable onto the drum 12, i.e. from the open position shown in FIG. 2 the grab is closable simply by lifting the cable eye 28 by means of the crane wire 30.

Thus, digging may be carried out by hoisting up the crane wire 30 when the grab is lying on the ground in open position, and when the grab is closed further hoisting will result in a lifting of the filled grab. The grab may then be moved to the place where it is desired to unload the grab contents, and here the grab is lowered so as to rest on the surface of the unloading area. By further lowering of the crane wire the control cable 20 will be wound onto the drum 12 by the action of the spring 32, and at the same time the grab cable 14 will be unwound so as to be slackened down into the grab, i.e. onto the surface of the grab contents.

Inside the housing 8 there is provided control means for arresting the drum in response to the control cable being entirely or almost entirely wound up on the drum or in response to renewed upwards hoisting of the eyelet 28. Therefore, when the crane wire 30 is thereafter pulled upwardly the housing 8 will be lifted without the control cable 20 being unwound from the pulley 16, i.e. with the grab cable 14 in its wound off condition. Hereby the lifting of the housing 8 will result in an opening of the grab because an upward pull will be exerted through the levers 10 and not through the cable or cables 14, so the lifting simply results in an unloading of the grab contents.

Thereafter the grab may be moved back to the place of digging and in its open position be deposited onto the surface of this place. The said control means are adapted so as to now be responsive to slackening of the cable 20 or to renewed tightening thereof and to thereby cause the drum 12 to be de-arrested. Thus, renewed hoisting up of the crane wire 30 will cause the opened grab to be closed, i.e. to carry out digging, and thereafter to be lifted, and herewith the described working cycle is completed and can be repeated.

Figure 4:
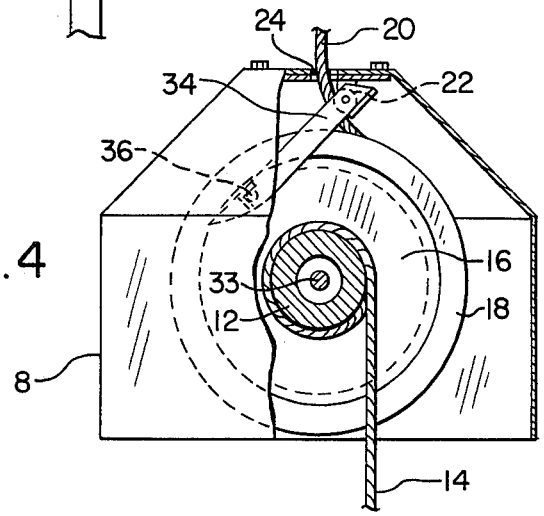
FIG. 4 is a corresponding side elevation, shown partly in section.

An embodiment of the said control means is illustrated in FIG. 5 and partly also in FIGS. 3 and 4. It comprises a pawl member 34 which is pivotally secured, e.g. to the shaft of the guiding roller 22 and extends down along the exterior side of the pulley 16 in an inclined position as shown in FIGS. 4 and 5. On the side of the pulley 16 there is mounted a protruding pin 36 cooperating with the pawl member as described in the following.

The main body of the pawl member 34 is located outside the path of movement of the pin 36, but it is provided with different portions projecting laterally into this path of movement. As will be apparent from FIGS. 5*a* and 5*b* the pawl 34 will allow clockwise rotation of the pulley 16 without any obstruction, since the front end of the pawl is inclined in such a manner that its aligned protruding front and rear lift cams 38 and 40 will lift the pawl by the passage of the pin 36. This clockwise movement corresponds to rotation driven by the spring 32, i.e. to winding up of the control cable 20 and winding off the grab cable 14.

Along the outer end of the lower edge of the pawl 34 there is provided a rear support cam 42 having an inwardly bent exterior portion 44 extending a short distance parallel with the rear lift cam 40 and spaced therefrom sufficiently to leave space for the pin 36 to pass therebetween. Therefore, when the pin passes over the rear edge of the cam 40 the pawl 34 will fall down a little until the cam portion 44 is supported on the pin, which is thereafter moved along the rear support cam 42, see FIG. 5*b*. Hereby the pawl is swung down into a first or lower position of rest as defined by suitable stop means 46, see FIG. 5*a*, and the pin 36 leaves the pawl for carrying out a further orbit by the continued rotation of the pulley 16.

Figure 1:
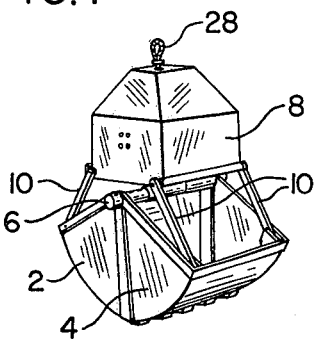
FIGS. 1 and 2 are perspective views of a grab according to the invention shown in closed and open condition, respectively.

When the control cable 20 has hereby been entirely wound up on the pulley, i.e. drawn into the housing 8, the stop member 26 underneath the eye 28 will abut against the top side of the housing 8 adjacent the hole 24 and thus prevent further rotation of the drum and the pulley. The member 24 is mounted in such a position on the control cable 20 that when this situation occurs the pulley will assume an angular position corresponding to the one shown in FIG. 5*b*, i.e. in which the cam 42 is rested on the pin 36. This situation will become actual when the closed grab has been placed on the surface where it is desired to unload the grab, i.e. in the position shown in FIG. 1, where the grab is supported on the ground and the crane wire has been lowered sufficiently to allow the control cable 20 to be retracted into the housing 8 until the stop member 26 hits the top of the housing, i.e. until the crane wire has just started slackening. As mentioned, in this position the grab cables 14 will be fully unwound from the drum 12 and lie loosely on the top of the grab contents.

When thereafter the crane wire 30 is again hoisted up the pulley 16 is affected so as to start anticlockwise rotation. Hereby the pawl 34 will be able to swing down a little as the pin 36 passes from the cam 42 along the cam portion 44 through the said space between cam portion 44 and rear lift cam 40. At the rear side of the cam 40 there is provided an angular cam having a portion 48 projecting rearwardly from the cam 40 and a portion 50 projecting rearwardly from the outer end of the portion 48 substantially parallel with the main direction of the pawl and to a point situated above the free end of the cam portion 44 and spaced therefrom sufficiently to allow the pin 36 to pass therebetween.

Figure 5A:
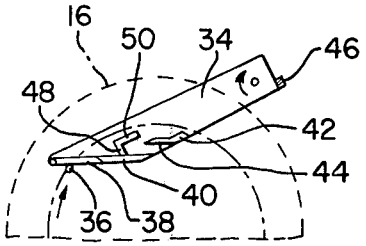
FIG. 5 is a plan view of the main part of the control or selector mechanism, shown in a number of different positions.
Figure 5B:
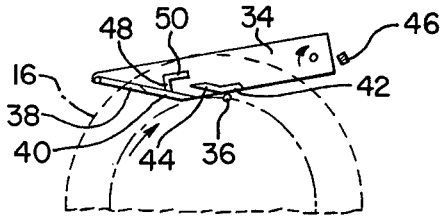
Figure 5C:
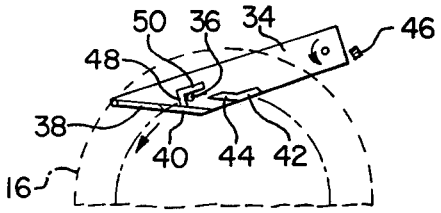

Therefore, when the pulley 16 starts anticlockwise rotation in response to renewed hoisting of the crane wire the pin 36, as mentioned, will be moved along the cam portion 44, and when passing the free end thereof the pawl will fall down to bring the cam portion 50 to rest on the pin, and the pin will then move along the cam portion 50 until it hits the cam or stop portion 48 as shown in FIG. 5*c*. By this engagement further rotation of the pulley and the drum will be prevented, i.e. by continued hoisting of the crane wire the entire housing 8 will now be lifted with the control cable 20 pulled only slightly out therefrom, e.g. as shown in FIG. 3.

By the lifting of the housing 8 the grab will be free to open itself by the action of the gravity and by the cables 14 already being slackened, so the grab will be unloaded simply in direct response to its being lifted off the ground.

Thereafter the crane operator may move the grab to the digging position and deposit it where it is desired to dig. Here he lowers the crane wire not only until the grab is rested on the ground, but a little further until the crane wire tends to slacken, i.e. until the drum spring 32 has had the opportunity to rotate the drum and pulley slightly anticlockwise so as to pull in the control cable 20 until the stop member 26 again engages the top of the housing. By this movement the pin 36 will leave its engagement with cam portion 48 and be guided back along cam portion 50 and out through the space between this portion and the end of portion 44. Therefore, during its motion towards its well defined stop position (shown in FIG. 5*b*) the pin 36 will leave the free end of the cam portion 50 whereby the pawl is free to fall down into its position of rest (FIGS. 5*a* and 5*d*).

Figure 5D:
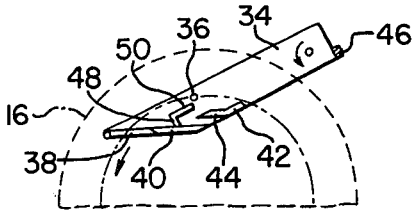

When thereafter the crane operator again hoists up the crane wire 30 nothing will then prevent the pin 36 from passing the cam portions 48 and 50, see FIG. 5*d*, i.e. the drum starts to rotate in order to pull up the grab cables 14 for closing the grab and thus cause it to carry out digging.

Figure 5E:
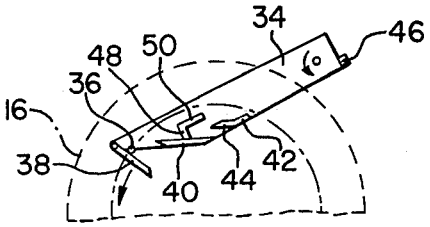

As mentioned in connection with FIGS. 5*a* and 5*b* the front end of the pawl shall be situated so as to be hit and lifted by the pin 36 in case of clockwise rotation of the pulley. This means that by anticlockwise rotation the pawl nose would obstruct the free passage of the pin 36, but in order to overcome this difficulty the outer cam 38, as shown in FIG. 5*e*, is arranged so as to be openable by the pressing action exerted by the pin when passing in anticlockwise direction. Alternatively the pawl stop member 46 may be the end of a spring enabling the pawl as a whole to be pressed down by the pin 36 pressing on the rear side of the cam 38 whereby the pin may pass unobstructed over the outer end of the cam 38 whereafter the pawl returns to its second or normal position of rest.

It will be noted that the cam 42 in rearward direction is not long enough to cause obstruction against the passage of the pin 36 at this place.

Thus, by hoisting the crane wire the grab will be closed and filled, and after complete closing the drum further hoisting will result in the entire grab structure being lifted. The position of the pin 36 in the closed condition of the grab is not critical.

When the grab is thereafter deposited on the unloading area and the crane wire is lowered still further the spring 32 will now again cause the control cable 20 to be wound onto the pulley 16 and the grab cable 14 to be wound off the drum, and the described cycle of operation may then be repeated.

Many modifications of the control system for preselecting the mode of operation of the drum may be made.

Even electromagnetic means may be used for operating the stop means. Such electromagnetic means could be actuated by current supplied from a battery inside the housing 8 and could be controlled by suitable feeder means responsive to the successive changes in the operation conditions.

While I have shown and described a preferred embodiment of my invention it will be apparent to those skilled in the art that changes and modifications may be made without departing from my invention in its broader aspects.

I claim:

1. A grab, adapted for suspension from and operation by a single crane wire, comprising:

a housing suspendable from a crane wire;

at least two levers pivotally secured at one end to and depending from said housing;

two opposed grab halves each pivotally secured one to each of said levers to the other end thereof;

a grab shaft on which each of said halves is journaled;

a rotatable drum mounted on said housing parallel with said grab shaft;

a control cable one end of which is secured to and windable around said drum and the other end of which is adapted for connection to said crane wire;

a grab cable one end of which is connected to and windable around said drum and the other end of which is secured to said grab shaft;

a spring operably connected between said drum and said housing which tends to rotate said drum so as to wind up said control cable;

a pawl member pivotally mounted at one end to said housing and having a plurality of protruding cams; and a pin operably connected to said drum and positionable to engage said cams, but not the main body of said pawl, said cables being arranged such that when said control cable is hoisted it winds off the drum, said spring tightens, and said grab cable winds onto said drum causing said grab halves to close and also arranged such that when said control cable is subsequently slacked, said tightened spring rotates said drum so that said control cable rewinds onto said drum and said grab cable winds off of said drum causing said grab halves to reopen, said pawl member being movable, alternately, between a first position wherein rotation of said drum is allowed in either direction whereby the grab halves close for digging in response to said control cable being hoisted by said crane wire, and a second position wherein rotation of said drum corresponding to rotation driven by said spring is allowed, but rotation in the opposite direction is not allowed whereby the grab halves are allowed to open themselves when they have been placed on a solid surface and remain open as said control cable is thereafter hoisted by said crane wire;

said pin and said cams interacting automatically to shift said pawl from one of said positions to the other whenever said grab halves are deposited on a solid surface and said control cable is slackened, such that when said grab halves are so deposited while closed, subsequent hoisting of said crane wire causes said grab halves to open and such that when said grab halves are so deposited while open, subsequent hoisting of said crane wire causes said grab halves to close;

two of said cams comprising front and rear lift cams positioned in the path of said pin such that when said grab halves are deposited on a solid surface while closed, the resultant slackening of said control cable allows rotation of said drum corresponding to rotation driven by said spring which rotation brings said pin into contact with said lift cams and causes said pawl to be raised to said second position;

another of said cams comprising a rear support cam spaced from said rear lift cam sufficiently to leave a space for said pin to pass therebetween, said support cam being located such that when said control cable is fully slacked, said support cam rests on said pin;

another of said cams comprising a cam having portions projecting upwardly and overlyingly of said rear lift cam such that, when said support cam is resting on said pin, hoisting of said control cable, which causes said drum to rotate in said opposite direction, moves said pin through the space between the rear lift cam and rear support cam until it engages said portions which block continued movement of said pin and thus terminate rotation of said drum in said opposite direction and thereby prevent the grab halves from closing as said control cable is further hoisted;

said support cam being spaced from said portions sufficiently to define a passage through which said pin can pass such that when said pin engages said portions, slacking of said control cable allows rotation of said drum corresponding to rotation driven by said spring which rotation causes said pin to move through said passageway to a position above said support cam thus allowing said pawl to fall into said first position;

said cams being shaped and positioned such that when said pawl is in said first position, hoisting of the control cable, which causes said drum to rotate in said opposite direction, moves said pin over said portions and then beneath said front lift cam which is hinged to open for allowing passage of said pin therebeneath when struck on its upper surface by said pin so that said drum is not prevented from rotating in said opposite direction and thereby said grab halves are closed as said cable is hoisted.

2. A lifting device adapted for suspension from and operation by a single wire comprising:

a housing;

a rotatable drum mounted horizontally on said housing;

a control cable one end of which is secured to and windable around said drum and the other end of which is adapted for connection to said wire;

a grab cable one end of which is connected to and windable around said drum and the other end of which is secured to the object to be lifted;

a spring operably connected between said drum and said housing which tends to rotate said drum so as to wind up said control cable;

a pawl member pivotally mounted at one end to said housing and having a plurality of protruding cams; and a pin operably connected to said drum and positionable to engage said cams, but not the main body of said pawl;

said cables being arranged such that when said control cable is hoisted it winds off the drum, said spring tightens, and said grab cable winds onto said drum causing said grab halves to close and also arranged such that when said control cable is subsequently slacked, said tightened spring rotates said drum so that said control cable rewinds onto said drum and said grab cable winds off of said drum causing said grab halves to reopen;

said pawl member being movable between a first position wherein rotation of said drum is allowed in either direction and a second position wherein rotation of said drum corresponding to rotation driven by said spring is allowed, but rotation in the opposite direction is not allowed;

two of said cams comprising front and rear lift cams positioned in the path of said pin such that rotation of said drum corresponding to rotation driven by said spring brings said pin into contact with said lift cams and causes said pawl to be raised to said second position;

another of said cams comprising a rear support cam spaced from said rear lift cam sufficiently to leave a space for said pin to pass therebetween, said support cam being located such that when said control cable is fully slacked, said support cam rests on said pin;

another of said cams comprising a cam having portions projecting upwardly and overlyingly of said rear lift cam such that, when said support cam is resting on said pin, hoisting of said control cable, which causes said drum to rotate in said opposite direction, moves said pin through the space between the rear lift cam and rear support cam until it engages said portions which block continued movement of said pin and thus terminate rotation of said drum in said opposite direction;

said support cam being spaced from said portions sufficiently to define a passage through which said pin can pass such that when said pin engages said portions rotation of said drum corresponding to rotation driven by said spring causes said pin to move through said passageway to a position above said support cam thus allowing said pawl to fall into said first position;

said cams being shaped and positioned such that when said pawl is in said first position, hoisting of the control cable, which causes said drum to rotate in said opposite direction, moves said pin over said portions and then beneath said front lift cam which is hinged to open for allowing passage of said pin therebeneath when struck on its upper surface by said pin.

* * * * *